US012092105B2

(12) United States Patent
Long et al.

(10) Patent No.: US 12,092,105 B2
(45) Date of Patent: Sep. 17, 2024

(54) ROTOR ASSEMBLY, COMPRESSOR AND AIR CONDITIONER

(71) Applicant: Gree Electric Appliances, Inc. of Zhuhai, Guangdong (CN)

(72) Inventors: Zhongkeng Long, Guangdong (CN); Xiaokun Wu, Guangdong (CN); Han Tang, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 0 days.

(21) Appl. No.: 18/268,748

(22) PCT Filed: Oct. 19, 2021

(86) PCT No.: PCT/CN2021/124635
§ 371 (c)(1),
(2) Date: Jun. 21, 2023

(87) PCT Pub. No.: WO2022/179132
PCT Pub. Date: Sep. 1, 2022

(65) Prior Publication Data

US 2024/0044333 A1 Feb. 8, 2024

(30) Foreign Application Priority Data

Feb. 26, 2021 (CN) ..... 202110220201.2

(51) Int. Cl.
*F04C 18/16* (2006.01)
*F04C 29/02* (2006.01)

(52) U.S. Cl.
CPC ..... *F04C 18/16* (2013.01); *F04C 29/021* (2013.01); *F04C 29/023* (2013.01); *F04C 29/028* (2013.01); *F04C 2240/603* (2013.01)

(58) Field of Classification Search
CPC ..... F04C 18/16; F04C 29/02; F04C 29/021; F04C 29/023; F04C 29/028; F04C 29/042; F04C 2240/603
See application file for complete search history.

(56) References Cited

U.S. PATENT DOCUMENTS 3,558,248 A * 1/1971 Parker ..... F04C 29/023 418/88
5,624,249 A * 4/1997 Rohlfing ..... F04C 2/16 418/202
2001/0036417 A1* 11/2001 Hioki ..... F04C 29/026 418/98

FOREIGN PATENT DOCUMENTS

CN 102878079 A 1/2013
CN 106704179 A 5/2017
CN 108757450 A 11/2018
CN 108916048 A 11/2018
(Continued)

*Primary Examiner* — Theresa Trieu
(74) *Attorney, Agent, or Firm* — The Webb Law Firm

(57) ABSTRACT

A rotor assembly, a compressor and an air conditioner are provided. The rotor assembly includes a first rotation shaft and a first rotor rotatably arranged on the first rotation shaft. The first rotor includes a plurality of first screw blades, and a first tooth slot is formed between two adjacent first screw blades; a suction end of the first rotor has at least one oil slinger slot, to allow a lubricant to enter the first tooth slot through the at least one oil slinger slot. It is ensured that the lubricant can fully lubricate and seal the first tooth slot, so that the compressor can run more smoothly, reduce wear of screw blades and improve the service life of the compressor.

14 Claims, 5 Drawing Sheets

(56) References Cited

FOREIGN PATENT DOCUMENTS

| | | | |
|---|---|---|---|
| CN | 110821830 | A | 2/2020 |
| CN | 111043033 | A | 4/2020 |
| CN | 112780558 | A | 5/2021 |
| JP | S61272489 | A | 12/1986 |
| JP | 2008127990 | A | 6/2008 |

* cited by examiner

ROTOR ASSEMBLY, COMPRESSOR AND AIR CONDITIONER

CROSS-REFERENCE TO RELATED APPLICATIONS

The present disclosure is a U.S. National Stage Application of International Patent Application No. PCT/CN2021/124635, filed Oct. 19, 2021, and claims priority to Chinese Patent Application No. 202110220201.2, filed Feb. 26, 2021, the disclosures of which are incorporated by reference herein in their entireties.

BACKGROUND OF THE INVENTION

Field of the Invention

The present invention relates to the technical field of compressors, in particular to a rotor assembly, a compressor and an air conditioner.

Description of Related Art

The opposed four-rotor screw compressor includes two pairs of spiral rotors, each pair of spiral rotors is arranged in the space volume of the housing of the screw compressor, wherein each pair of spiral rotors respectively includes a parallel female rotor and a male rotor with opposite rotation directions, and the female rotor and the male rotor are meshed with each other. During the rotation of two pairs of spiral rotors, the volume will increase and decrease periodically. By means of a reasonable design, the volume is periodically communicated and disconnected with the air inlet and the air outlet, so that the whole process of suction, compression and exhaust can be completed.

SUMMARY OF THE INVENTION

Through the research of the inventors, during the rotation of each pair of female and male rotors meshed each other, friction tends to occur at the meshing position of the female and male rotors, which leads to the need for lubrication at the meshing position of the female and male rotors. However, the opposed four-rotor screw compressor in the related art has not disclosed effective measures for lubrication at the meshing position of the female and male rotors, and the lubricant cannot flow into the rotor tooth grooves, which leads to no lubricant in the rotor tooth grooves for lubrication. In the long run, it is likely to cause the wear of screw blades, lead to poor operation of the compressor and reduce the service life of the compressor.

In view of this, the embodiment of the present disclosure provides a rotor assembly, a compressor and an air conditioner, which can solve the technical problem that the rotor assembly in the related art cannot lubricate the meshing position of a female rotor and a male rotor.

In one aspect of the present disclosure, a rotor assembly is provided and includes: a first rotation shaft; and a first rotor rotatably arranged on the first rotation shaft, wherein the first rotor includes a plurality of first screw blades, a first tooth slot is formed between two adjacent first screw blades, and a suction end of the first rotor has at least one oil slinger slot, to allow a lubricant to enter the first tooth slot through the at least one oil slinger slot.

In some embodiments, the rotor assembly further includes: a second rotation shaft; and a second rotor fixedly arranged on the second rotation shaft, wherein the second rotor is meshed with the first rotor and configured to drive the first rotor to rotate relative to the first rotation shaft, and the first rotor and the second rotor rotate in opposite directions; the second rotor includes a plurality of second screw blades, and a second tooth slot is formed between two adjacent second screw blades.

In some embodiments, the rotor assembly includes two first rotors and two second rotors; wherein the two first rotors are coaxially arranged on the first rotation shaft, and threads of the two first rotors are in opposite directions; the two second rotors are coaxially fixed on the second rotation shaft, and threads of the two second rotors are in opposite directions.

In some embodiments, suction ends of the two first rotors are engaged with each other, and at least one of the suction ends of the two first rotors has at least one oil slinger slot.

In some embodiments, the at least one oil slinger slot is formed at a junction of two adjacent first screw blades.

In some embodiments, the at least one oil slinger slot is formed on the first screw blade.

In some embodiments, the suction end further has at least one oil storage cavity, and the at least one oil storage cavity is communicated with the at least one oil slinger slot and is communicated with the first tooth slot through the at least one oil slinger slot.

In some embodiments, the at least one oil storage cavity is formed by one end of the first screw blade close to the suction end being recessed in a direction away from the suction end.

In some embodiments, the first rotation shaft is internally provided with a main oil path and at least one branch oil path communicating with the main oil path; a lubrication clearance is formed between the first rotor and the first rotation shaft, and the lubrication clearance is communicated with the at least one branch oil path and the at least one oil slinger slot.

In some embodiments, the rotor assembly further includes a plurality of support bearings sleeved outside the first rotation shaft and supporting the first rotor, wherein the plurality of support bearings and the first rotor are rotatable relative to the first rotation shaft; a gap is arranged between two adjacent support bearings, and the gap is communicated with the branch oil path and the lubrication clearance.

In some embodiments, an inner wall of the first rotor facing the first rotation shaft has an oil storage slot communicating with the lubrication clearance.

In some embodiments, the rotor assembly further includes: a first bearing housing arranged at one end of the second rotation shaft, wherein a first bearing cavity is arranged between the first bearing housing and the second rotation shaft; a first bearing arranged on the second rotation shaft and accommodated in the first bearing cavity; a flow dividing part including a overall oil inlet, a first oil outlet and a second oil outlet, wherein two ends of the first oil outlet are respectively communicated with the overall oil inlet and the main oil path, and two ends of the second oil outlet are respectively communicated with the overall oil inlet and the first bearing cavity; and a rotor housing configured to accommodate the first rotor and the second rotor, wherein the rotor housing has a first oil return port communicated with the first bearing cavity and the second tooth slot.

In some embodiments, the rotor assembly further includes: a second bearing housing arranged at the other end of the second rotation shaft, wherein a second bearing cavity is arranged between the second bearing housing and the second rotation shaft; a second bearing arranged on the second rotation shaft and accommodated in the second bearing cavity; an oil control part including a third oil outlet, wherein two ends of the third oil outlet are respectively communicated with the main oil path and the second bearing cavity; and a second oil return port arranged on the rotor housing, wherein the second oil return port is communicated with the second bearing cavity and the second tooth slot.

In one aspect of the present disclosure, a compressor is provided and includes the rotor assembly described above.

In one aspect of the present disclosure, an air conditioner is provided and includes the compressor described above.

According to the rotor assembly, the compressor and the air conditioner provided by the embodiment of the disclosure, the rotor assembly includes a first rotation shaft and a first rotor rotatably arranged on the first rotation shaft, wherein the first rotor includes a plurality of first screw blades, and a first tooth slot is formed between two adjacent first screw blades; at least one oil slinger slot is arranged at the suction end of the first rotor, and the oil slinger slot is used for feeding a lubricant into the first tooth slot through the oil slinger slot, so that the lubricant can fully lubricate and seal the first tooth slot, therefore the operation of the compressor is smoother, the wear degree of screw blades is reduced, and the service life of the compressor is prolonged.

BRIEF DESCRIPTION OF THE DRAWINGS

In order to more clearly explain the technical scheme in the embodiments of the present disclosure, the drawings needed in the description of the embodiments will be briefly introduced below. Obviously, the drawings in the following description are only some embodiments of the present disclosure. For those skilled in the art, other drawings can be obtained according to these drawings without creative work.

DESCRIPTION OF REFERENCE SIGNS

Figure 1:
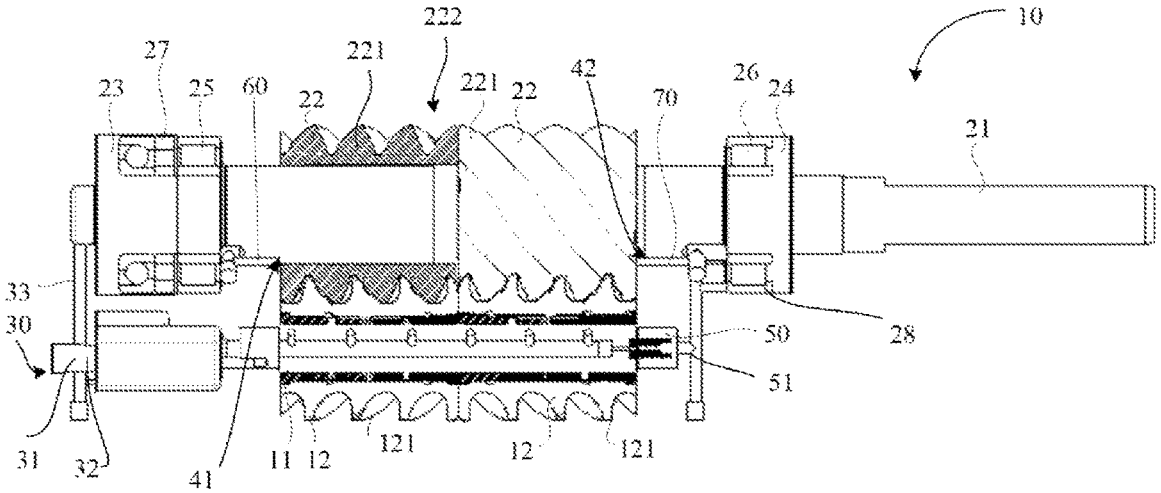
FIG. 1 is a structural schematic diagram of a rotor assembly provided by an embodiment of the present disclosure.

10, Rotor assembly; 11, First rotation shaft; 12, First rotor; 121, First screw blade; 122, First tooth slot; 123, Suction end; 124, oil slinger slot; 125, Oil storage cavity; 111, Main oil path; 112, Branch oil path; 126, Lubrication clearance; 127, Support bearing; 1271, Bearing Gap; 1272, bush; 1273, Communication hole; 1274, Through groove; 128, Oil storage slot;

21, Second rotation shaft; 22, Second rotor; 221, Second screw blade; 222, Second tooth slot; 23, First bearing housing; 24, Second bearing housing; 25, First bearing cavity; 26, Second bearing cavity; 27, First bearing; 28, Second bearing;

30, Flow dividing part; 31, Overall oil inlet; 32, First oil outlet; 33, Second oil outlet;

40, Rotor housing; 41, First oil return port; 42, Second oil return port;

50, Oil control part; 51, Third oil outlet;

60, First oil return part;

70, Second oil return part.

DESCRIPTION OF THE INVENTION

In the following, the technical scheme in the embodiment of the disclosure will be clearly and completely described with reference to the attached drawings. Obviously, the described embodiment is only a part of the embodiment of the disclosure, but not the whole embodiment. Based on the embodiments in this disclosure, all other embodiments obtained by those skilled in the art without creative work belong to the protection scope of this disclosure. Furthermore, it should be understood that the specific embodiments described herein are only used to illustrate and explain this disclosure, and are not used to limit this disclosure. In this disclosure, unless otherwise stated, directional words such as "up" and "down" usually refer to the up and down in the actual use or working state of the device, specifically the drawing direction in the drawings; while "inside" and "outside" refer to the outline of the device.

The embodiment of the disclosure provides a rotor assembly, a compressor and an air conditioner, which will be described in detail below. It should be noted that the description order of the following embodiments is not taken as a limitation to the preferred order of the embodiments.

The present disclosure provides a rotor assembly, which is applied to a compressor. Please refer to FIGS. 1 and 2 for details. The rotor assembly 10 includes a first rotation shaft 11 and a first rotor 12 rotatably arranged on the first rotation shaft 11. The first rotor 12 includes a plurality of first screw blades 121, and a first tooth slot 122 is formed between two adjacent first screw blades 121. The first rotor 12 is formed by splicing a plurality of first screw blades 121, and bottoms of the first screw blades 121 are connected with each other and sleeved outside the first rotation shaft 11.

Figure 3:
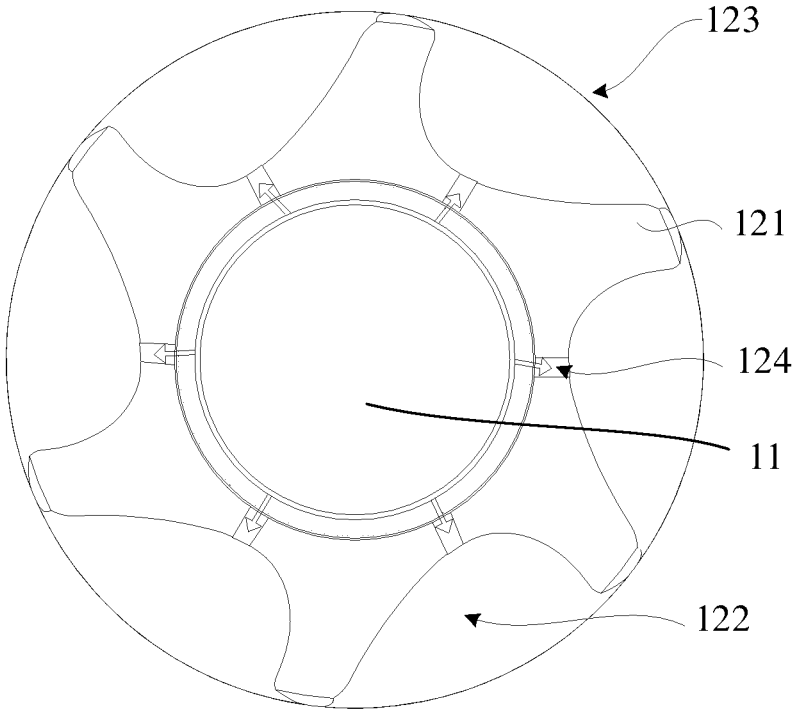
FIG. 3 is a schematic view of the first structure of the suction end of the first rotor in the rotor assembly shown in FIG. 1.

Please refer to FIG. 3, the first rotor 12 includes a suction end 123 with at least one oil slinger slot 124, so as to allow lubricant to enter the first tooth slot 122 through the oil slinger slot 124, thus effectively lubricating and sealing the first tooth slot 122, making the compressor run more smoothly, reducing the wear of screw blades and prolonging the service life of the compressor.

The rotor assembly 10 further includes a second rotation shaft 21 and a second rotor 22. The second rotor 22 can rotate around the axis of the second rotation shaft 21, and the second rotation shaft 21 is arranged in parallel with the first rotation shaft 11. The second rotor 22 is fixedly arranged on the second rotation shaft 21, and the second rotor 22 and the first rotor 12 are engaged with each other to realize gas compression, and the first rotor 12 and the second rotor 22 rotate in opposite directions.

It can be understood that the first rotor 12 is a driven rotor and the second rotor 22 is a driving rotor, that is, the second rotor 22 drives the first rotor 12 to rotate. In the embodiment of the present disclosure, the first rotor 12 may be a female rotor and the second rotor 22 may be a male rotor, or the first rotor 12 may be a male rotor and the second rotor 22 may be a female rotor.

Specifically, the second rotor 22 includes a plurality of second screw blades 221, and a second tooth slot 222 is formed between two adjacent second screw blades 221. The second rotor 22 is formed by splicing a plurality of second screw blades 221, and bottoms of the plurality of second screw blades 221 are connected with each other and sleeved outside the second rotation shaft 21, and the meshing area between the second screw blades 221 and the first screw blades 121 is the inter-tooth volume of the rotor.

It can be understood that since the lubricant can enter the first tooth slot 122 through the oil slinger slot 124, and the lubricant can also enter the second tooth slot 222, so that the second rotor 22 can be lubricated.

In some embodiments, the oil slinger slot 124 is formed at the junction of two adjacent first screw blades 121, that is, the oil slinger slot 124 is formed at the bottom end of the first tooth groove 122. It should be noted that the "junction" may be a position where one screw blade is adjacent to the other screw blade, or a position that parts of two screw blades form. At this time, the path of the oil slinger slot 124 is the shortest, so that the lubricant can quickly enter the first tooth slot 122 through the oil slinger slot 124.

Figure 5:
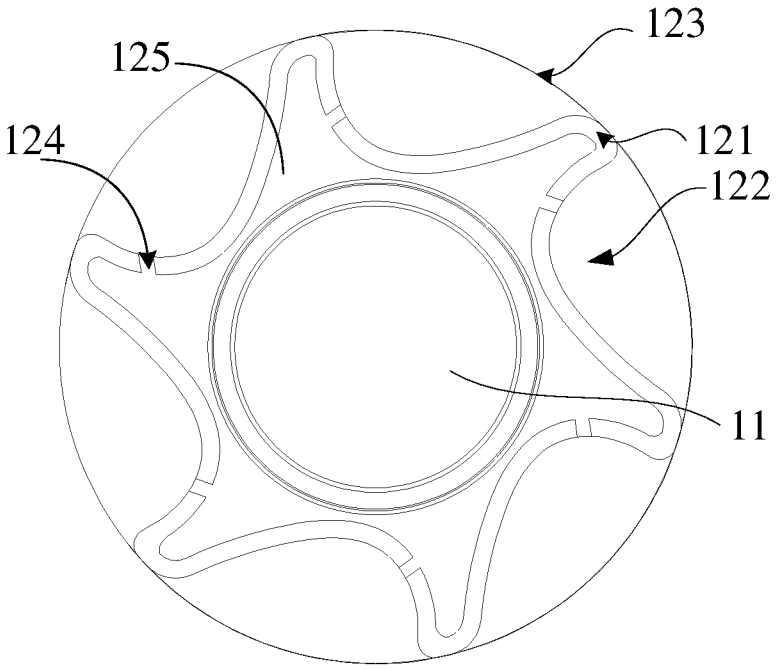
FIG. 5 is a schematic view of the third structure of the suction end of the first rotor in the rotor assembly shown in FIG. 1.

In some embodiments, please refer to FIG. 5, the oil slinger slot 124 is arranged on the first screw blade 121, and two adjacent oil storage cavities 125 communicate with each other. On one hand, when the oil inlet velocity of lubricant is too fast, the oil inlet velocity can be delayed due to the long path of the oil slinger slot 124; on the other hand, the lubricant in the oil storage cavity 125 can be quickly squeezed to the first tooth slot 122 due to the pressure increase.

In some embodiments, the first rotor 12 may be made of a self-lubricating nonmetallic material, and the first rotation shaft 11 may be made of a carbide alloy material. Of course, the first rotor 12 may be made of carbide alloy material, and the first rotation shaft 11 may be made of a self-lubricating nonmetallic material.

In some embodiments, the second rotor 22 may be made of a self-lubricating nonmetallic material. When the first rotor 12 is made of hard alloy steel and the second rotor 22 is made of a self-lubricating nonmetallic material, the meshing motion between the first rotor 12 and the second rotor 22 is made of metal and nonmetallic materials, which is beneficial to increase the transmission smoothness and reduce the vibration and noise during the operation of the rotor assembly 10.

In some embodiments, the rotor assembly 10 may also be composed of two pairs of rotors meshing with each other. Specifically, the rotor assembly 10 includes two first rotors 12 and two second rotors 22. The two first rotors 12 are coaxially arranged on the first rotation shaft 11, and threads of the two first rotors 12 are in opposite directions. Alternatively, the two first rotors 12 are symmetrically arranged. Two second rotors 22 are coaxially fixed on the second rotation shaft 21, and threads of the two second rotors 22 are in opposite directions. Alternatively, the two second rotors 22 are symmetrically arranged.

The end faces of the two first rotors 12 that are close to each other are joined, and the end faces of the two second rotors 22 that are close to each other are joined, so that the rotor assembly 10 draws gas from the position joined. The gas respectively flows to the first rotors 12 on both sides to compress and exhaust, and the lubricant flowing into the first tooth groove 122 and the second tooth groove 222 through the oil slinger slot 124 can be compressed with the gas and be discharged from the exhaust end faces of the first rotor 12 and the second rotor 22, so that the lubrication of all of the first tooth grooves 122 and the second tooth grooves 222 can be completed.

The compression capacities of the first rotor 12 and the second rotor 22 are equivalent to those of a group of ordinary rotors, and the compression capacities of the two first rotors 12 and the two second rotors 22 are equivalent to those of two groups of ordinary rotors, and their volumes are much smaller than those of two groups of ordinary rotors, thus making the structure of the whole rotor assembly 10 more compact. According to actual needs, in some embodiments, only one of the two first rotors 12 can be provided with the oil slinger slot 124, or both first rotors 12 can be provided with the oil slinger slot 124 to further improve the oil exhausting speed.

Figure 4:
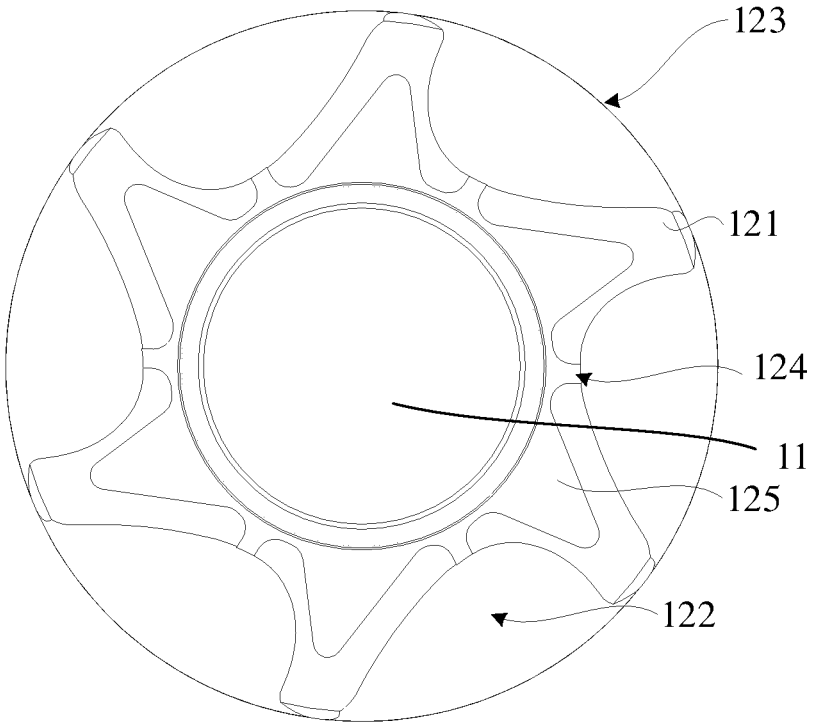
FIG. 4 is a schematic view of the second structure of the suction end of the first rotor in the rotor assembly shown in FIG. 1.

Understandably, please refer to FIG. 4 and FIG. 5, the first rotor 12 needs lubrication, and the suction end 123 is also provided with at least one oil storage cavity 125. The oil storage cavity 125 communicates with the oil slinger slot 124, and the oil storage cavity 125 communicates with the first tooth groove 122 through the oil slinger slot 124. In the embodiment of the present disclosure, a lubricant can flow into the oil storage cavity 125. Because the oil storage cavity 125 can store lubricant, when the rotor assembly 10 is started, the lubricant stored in the oil storage cavity 125 can be squeezed into the oil slinger slot 124 and then quickly enter the first tooth groove 122 through the oil slinger slot 124, so that the first rotor 12 can be lubricated. During the rotation of the first rotor 12, the lubricant in the oil storage cavity 125 can enter the first tooth slot 122 from the side, and then the lubricant is compressed and exhausted together with the gas, thus avoiding the problem that the first rotor 12 is not lubricated at the initial working stage, resulting in the wear of the first rotor 12. Because the volume of the oil storage cavity 125 is large enough, it can have enough oil storage capacity to meet the lubrication requirements.

Similarly, according to actual needs, in some embodiments, only one of the two first rotors 12 can be provided with the oil storage cavity 125, or both first rotors 12 can be provided with the oil storage cavity 125.

In some embodiments, the oil storage cavity 125 is formed by one end of the first screw blade 121 that is close to the suction end 123 being recessed in a direction away from the suction end 123. That is, the oil storage cavity 125 is formed on the first screw blade 121.

In some embodiments, each first screw blade 121 is provided with an oil storage cavity 125, and each first tooth slot 122 is correspondingly provided with an oil slinger slot 124.

In some embodiments, the shape of the oil storage cavity 125 is basically the same as that of the end of the first screw blade 121 close to the suction end 123, so that the volume of the oil storage cavity 125 is larger to store more lubricant, thus meeting the lubrication requirements of the rotor assembly 10. However, in order to avoid damaging the first screw blade 121 and affecting the normal operation of the first rotor 12, a certain distance should be left between the inner wall of the oil storage cavity 125 and the outer wall of the first screw blade 121.

In some embodiments, the suction end 123 is also provided with a baffle (not shown in the figure), and the baffle is partially arranged corresponding to the oil storage cavity 125, so as to block the lubricant in the oil storage cavity 125 and prevent the lubricant from completely flowing out of the oil storage cavity 125, so that the lubricant can be stored in the oil storage cavity 125.

In some embodiments, the suction ends 123 of the two first rotors 12 are respectively provided with at least one oil slinger slot 124 and an oil storage cavity 125 communicating with the at least one oil slinger slot 124, and the oil storage cavity 125 communicates with the first tooth slot groove 122 through the oil slinger slot 124. The two first rotors 12 are provided with the oil storage cavities 125, so that when the rotor assembly 10 is started, the two first rotors 12 can be directly lubricated by the lubricants in the oil storage cavities 125, and at the same time, the two second rotors 22 can be directly lubricated by the lubricants in the oil storage cavities 125 on the corresponding first rotors, thereby reducing the lubrication pressure.

In some embodiments, the first rotation shaft 11 is internally provided with a main oil path 111 and at least one branch oil path 112 communicating with the main oil path 111, and a lubrication clearance 126 is formed between the first rotor 12 and the first rotation shaft 11, and the lubrication clearance 126 communicates with the branch oil path 112 and the oil slinger slot 124. The main oil path 111 is used for temporarily storing a lubricant. The lubricant flowing in from one end of the main oil path 111 flows through the branch oil path 112, one part of the lubricant flowing out from the branch oil path 112 flows into the first tooth groove 122 through the lubrication clearance 126 and the oil slinger slot 124, and the other part flows into the oil storage cavity 125, and is stored in the oil storage cavity 125.

Figure 6:
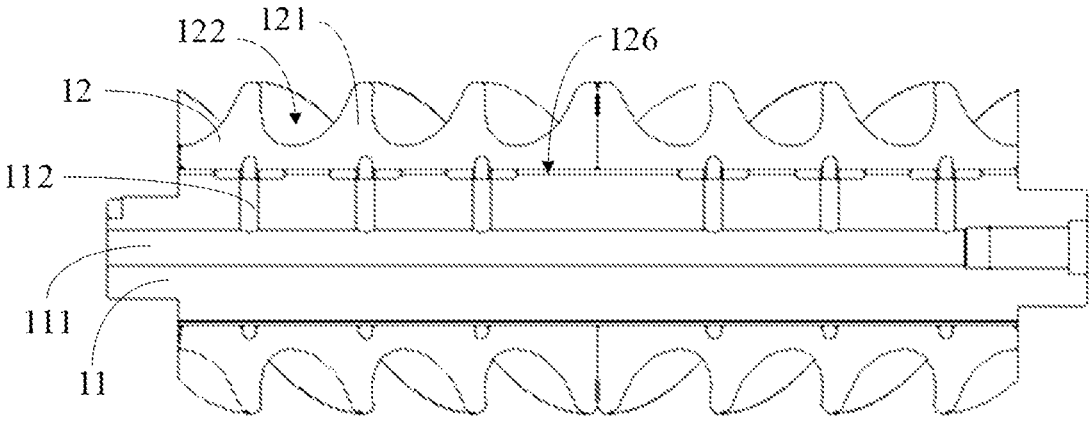
FIG. 6 is a second schematic sectional view of the first rotor and the first rotation shaft in the rotor assembly shown in FIG. 1.

Referring to FIG. 6, in some embodiments, the first rotor 12 is directly sleeved outside the first rotation shaft 11 and can rotate relative to the first rotation shaft 11, and the lubricant flowing out of the branch oil path 112 enters the lubrication clearance 126 between the first rotation shaft 11 and the first rotor 12.

Please refer to FIG. 2 again, in some embodiments, the difference between FIG. 2 and FIG. 6 is that the rotor assembly 10 further includes at least two support bearings 127, which are sleeved outside the first rotation shaft 11 and support the first rotor 12. The support bearings 127 and the first rotor 12 can rotate relative to the first rotation shaft 11. There is a gap 1271 between two adjacent support bearings 127, and the gap 1271 communicates with the branch oil path 112 and the lubrication clearance 126. The lubricant entering from one end of the main oil path 111 flows through the branch oil path 112, and the lubricant flowing out from the branch oil path 112 flows into the lubrication clearance 126 through the gap 1271. One part of the lubricant flowing out of the lubrication clearance 126 flows into the first tooth groove 122 through the oil slinger slot 124, and the other part flows into the oil storage cavity 125 and is stored in the oil storage cavity 125.

The number of sliding bearings can be set as required, for example, the number of sliding bearings can be any value from 1 to 6. The number of second channels can be any value from 2 to 12.

Figure 7:
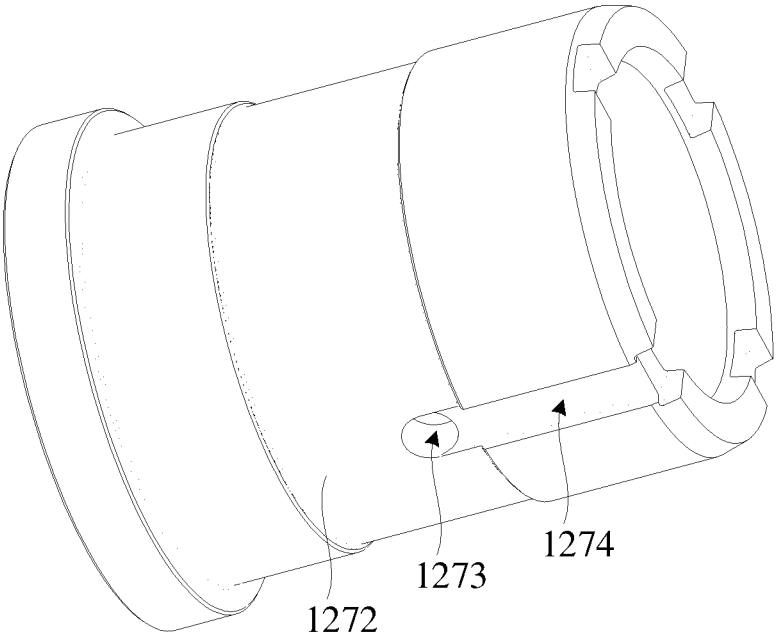
FIG. 7 is a schematic structural view of the bearing bush supporting the bearing in the rotor assembly shown in FIG. 1.

Referring to FIG. 7, the support bearing 127 includes a bearing bush 1272, and a gap is provided between the bearing bush 1272 and the first rotation shaft 11. It should be noted that the bearing bush 1272 is provided with a communication hole 1273 which communicates the inner surface and the outer surface of the bearing bush 1272, so that lubricant can lubricate the inner surface and the outer surface of the bearing bush 1272. The outer wall of the bearing bush 1272 is also provided with a through groove 1274 communicating with the communication hole 1273, and the through groove 1274 can accelerate flowing of the lubricant between the first rotor 12 and the first rotation shaft 11, so that the lubricant can flow to the oil slinger slot 124 more easily.

In some embodiments, the inner wall of the first rotor facing the first rotation shaft is provided with an oil storage slot 128 communicating with the lubrication clearance. A plurality of oil storage slots 128 can be provided, and at least one of oil storage slots 128 communicates with at least one of lubrication clearances 126. A certain amount of lubricant is stored in the oil storage slot 128 to provide the lubricant needed to the support bearing 127 during the startup of the rotor assembly. Specifically, during the startup of the rotor assembly 10, the lubricant in the oil storage slot 128 is squeezed into the lubrication clearance 126 to lubricate the support bearing 127.

Figure 2:
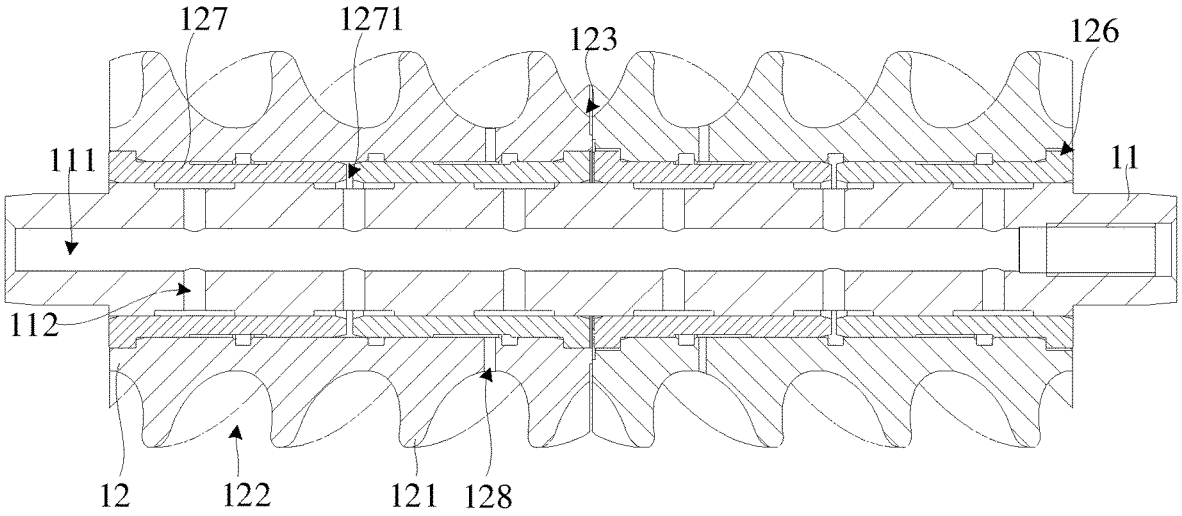
FIG. 2 is a first schematic sectional view of the first rotor and the first rotation shaft in the rotor assembly shown in FIG. 1.
Figure 8:
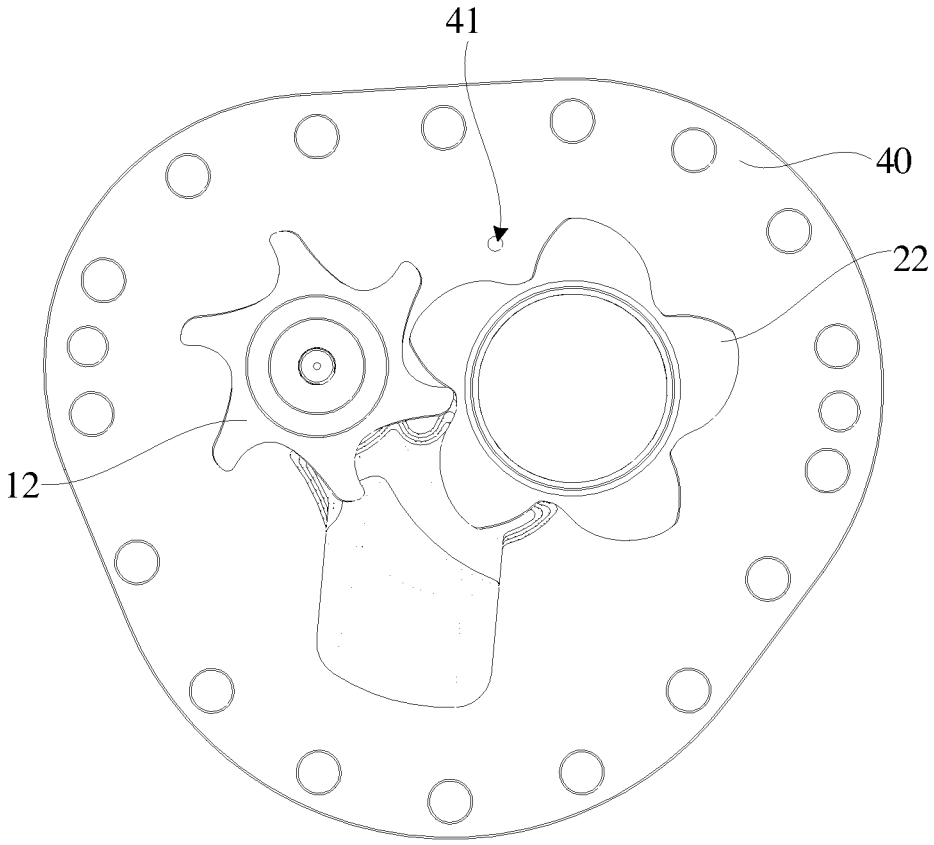
FIG. 8 is a schematic structural view of the first rotor, the second rotor and the rotor housing of the embodiment of the present disclosure.

Referring to FIGS. 1, 2 and 8, the rotor assembly 10 further includes a first bearing housing 23, a first bearing 27, a flow dividing part 30 and a rotor housing 40. The first bearing housing 23 is arranged at one end of the second rotation shaft 21, and a first bearing cavity 25 is arranged between the first bearing housing 23 and the second rotation shaft 21. The first bearing 27 is arranged on the second rotation shaft and accommodated in the first bearing cavity 25. The first bearing 27 is located on the motor side of the corresponding compressor.

In some embodiments, the flow dividing part 30 includes a overall oil inlet 31, a first oil outlet 32 and a second oil outlet 33, two ends of the first oil outlet 32 are respectively communicated with the overall oil inlet 31 and the main oil path 111, and two ends of the second oil outlet 33 are respectively communicated with the overall oil inlet 31 and the first bearing cavity 25, so that the lubricant from the overall oil inlet 31 respectively flows into the first oil outlet 32 and the second oil outlet 32. After being divided by the flow dividing part 30, one part of the lubricant flows into the main oil path 111 so as to lubricate the first rotation shaft 11 and the support bearing 127, and the other part flows into the first bearing cavity 25 so as to lubricate the first bearing 27.

In some embodiments, the flow dividing part 30 can be a throttle plug, which can not only divide the flow, but also control the flow velocity of lubricant.

In some embodiments, the rotor housing 40 is configured to accommodate the first rotor 12 and the second rotor 22. The rotor housing 40 has a first oil return port 41 communicating with the first bearing cavity 25, and the first oil return port 41 is arranged at one side of the rotor housing 40 close to the first bearing 27 and communicates with the second tooth slot 222.

In some embodiments, the rotor assembly 10 further includes a first oil return part 60 that connects the first bearing 27 and the first oil return port 41. The first oil return part 60 includes a first oil return cavity (not shown in the figure), one end of which communicates with the first bearing cavity 25 and the other end of which communicates with the first oil return port 41. After the lubricant in the first bearing cavity 25 lubricates the first bearing 27, the lubricant can enter the rotor housing 40 through the first oil return cavity and the first oil return port 41, and then enter the second tooth slot 222. Because the second tooth groove 222 faces towards the first oil return port 41, when the first rotor 12 and the second rotor 22 rotate, the air pressure in the area where the second tooth groove 222 is located is lower than that in other areas, so that the lubricant in the first bearing cavity 25 can easily enter the second tooth groove 222 and then be compressed and discharged together with the air.

In some embodiments, the rotor assembly 10 further includes a second bearing housing 24, a second bearing 28, an oil control part 50 and a second oil return port 42. The second bearing housing 24 is arranged at the other end of the second rotation shaft 21, and a second bearing cavity 26 is arranged between the second bearing housing 24 and the second rotation shaft 21. The second bearing 28 is arranged on the second rotation shaft 21 and accommodated in the second bearing cavity 26. The second bearing 28 is located on the side without a motor of the corresponding compressor.

In some embodiments, the oil control part 50 includes a third oil outlet 51, both ends of which are respectively communicated with the main oil path 111 and the second bearing cavity 26, and the lubricant from the overall oil inlet 31 flows into the third oil outlet 51 from the main oil path 111 and then flows into the second bearing cavity 26.

In some embodiments, the second oil return port 42 is arranged on the rotor housing 40, and communicates with the second bearing cavity 26. The second oil return port 42 is arranged on one side of the rotor housing 40 close to the second bearing 28 and communicates with the second tooth slot 222.

In some embodiments, the rotor assembly 10 further includes a second oil return part 70 that connects the second bearing 28 and the second oil return port 42. The second oil return part 70 includes a second oil return cavity (not shown), one end of which communicates with the second bearing cavity 26 and the other end of which communicates with the second oil return port 42. After the lubricant in the second bearing cavity 26 lubricates the second bearing 28, the lubricant can enter the rotor housing 40 through the first oil return cavity and the second oil return port 42, and then enter the second tooth slot 222. Similarly, because the second tooth slot 222 is facing towards the second oil return port 42, when the first rotor 12 and the second rotor 22 rotate, the air pressure in the area where the second tooth slot 222 is located is lower than that in other areas, so that the lubricant in the second bearing cavity 26 can easily enter the second tooth slot 222 and then be compressed and discharged together with the gas.

In an alternative embodiment of the present disclosure, the lubricant can be refrigeration oil, which can not only lubricate the rotor assembly 10, but also dissipate heat and refrigerate.

It can be understood that the oil path in the disclosed embodiment can complete oil supply of the bearing of the first rotor 12 and oil supply of the bearing lubrication of the left and right sides of the second rotor 22 through a general oil inlet 31. After bearing lubrication, the lubricant finally enters the inter-tooth volume of the rotor to lubricate the engagement between the first rotor 12 and the second rotor 22. The flow paths of lubricant can include three paths. The first oil path includes: the general oil inlet 31, the main oil path 111 in the first rotation shaft 11, the branch oil path 112 in the first rotation shaft 11, the lubrication clearance 126 between the first rotation shaft 11 and the support bearing 127, the air inlet end face of the first rotor 12, and the inter-tooth volume of the rotor. The second oil path includes an overall oil inlet 31, a first bearing cavity 25, a first oil return port 41 and an inter-tooth volume of the rotor. The third oil path includes an overall oil inlet 31, a main oil path 111 in the first rotation shaft 11, a second bearing cavity 26, a second oil return port 42 and inter-tooth volume of the rotor. Lubrication of the first rotor 12, the second rotor 22 and all bearings can be realized through one overall oil inlet 31.

The rotation directions of the two first rotors 12 are opposite, and the rotation directions of the two second rotors 22 are opposite, that is, the rotation directions of the first screw blades 121 of the two first rotors 12 are opposite, and the rotation directions of the second screw blades 221 of the two second rotors 22 are opposite. One pair of corresponding first rotor 12 and second rotor 22 generate an axial force in a first direction during compression, and the other pair of corresponding first rotor 12 and second rotor 22 generate an axial force in a second direction during compression. The first direction and the second direction are opposite, and the axial force in the first direction and the axial force in the second direction can at least partially cancel each other out, so that the problem of excessive axial force can be improved.

It should be noted that one pair of the corresponding first rotor 12 and second rotor 22 generates axial force in a first direction during compression, and the other pair of the corresponding first rotor 12 and second rotor 22 generates axial force in a second direction during compression, and the first direction and second direction are opposite. If the axial force in the first direction and the axial force in the second direction are completely offset, the bearing for supporting the first rotation shaft and second rotation shaft may only include radial bearings, and no thrust bearing is provided. If the axial force in the first direction and the axial force in the second direction are partially offset, the residual axial force is small, and the impact of the collision between the rotor housing 40 and each of the first rotor 12 and the second rotor 22 t is also small, then the bearings supporting the first rotation shaft and the second rotation shaft may only include radial bearings, and no thrust bearing are provided.

Understandably, because of the manufacturing process, both the first rotor 12 and the second rotor 22 have a certain tolerance range, so that the teeth of the two parts of the first rotor 12 are not completely symmetrical, and the teeth of the two parts of the second rotor 22 are not completely symmetrical, which further leads to the uncertainty of the direction of the axial force after the axial force in the first direction and the axial force in the second direction are partially offset, and it is necessary to set thrust bearings in two directions. In this embodiment, the structure of the first rotor 12 and/or the second rotor 22 can be changed so that within the tolerance range of the first rotor 12 and the second rotor 22, the axial force in one direction is always greater than the axial force in the other direction, so that the resultant force of the axial forces generated after the meshing rotation of the first rotor and the second rotor is a fixed direction, therefore only thrust bearing in one direction can be provided and thrust bearing in the other direction can be omitted. For example, by changing the structure of the first rotor 12, the axial force in the first direction is greater than the axial force in the second direction. Specifically, at least one of the length, diameter, tooth density, tooth thickness and end surface profile of each first rotor 12 can be changed, so that the axial force in the first direction generated by one pair of corresponding first rotor and second rotor during compression is greater than the axial force in the second direction generated by another pair of corresponding first rotor and second rotor during compression. Thus the thrust bearings corresponding to the axial force in the second direction on the first rotation shaft and the second rotation shaft is omitted.

The present disclosure also provides a compressor including the rotor assembly 10 as defined in combination with the above one or more embodiments. The compressor also includes a motor, which drives the second rotation shaft 21.

The second rotation shaft 21 drives the second rotor 22, and the second rotor 22 drives the first rotor 12.

Figure 9:
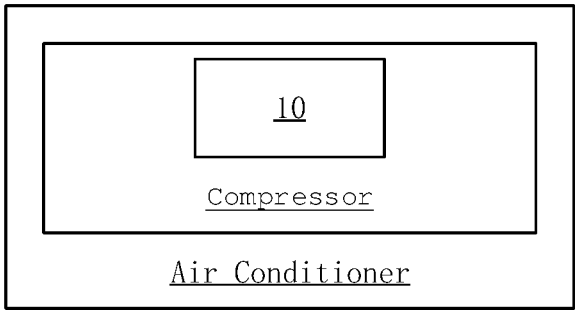
FIG. 9 is a schematic structural view of the air conditioner of the embodiment of the present disclosure.

FIG. 9 is a schematic structural view of the air conditioner of the embodiment of the present disclosure. Referring to FIG. 9, the present disclosure also provides an air conditioner including the compressor as defined in combination with the above one or more embodiments. The air conditioner also includes other components for air conditioning, which will not be described in detail here.

The present invention provides a rotor assembly, a compressor and an air conditioner. The rotor assembly includes a first rotation shaft and a first rotor rotatably arranged on the first rotation shaft, wherein the first rotor includes a plurality of first screw blades, and a first tooth slot is formed between two adjacent first screw blades; the suction end of the first rotor has at least one oil slinger slot, and the oil slinger slot is configured to allow the lubricant to enter the first tooth slot through the oil slinger slot, so that the lubricant can fully lubricate and seal the first tooth slot, and the compressor runs more smoothly.

The rotor assembly, the compressor and the air conditioner provided by an embodiment of the present disclosure are described in detail above, and the principle and implementation of the present disclosure have been expounded by using a specific example in this paper. The description of the above embodiment is only used to help understand the method and core idea of the present disclosure; at the same time, for those skilled in the art, according to the idea of this disclosure, there will be changes in the specific implementation and application scope. To sum up, the contents of this specification shall not be construed as a limitation to this disclosure.

What is claimed is:

1. A rotor assembly comprising:

a first rotation shaft; and a first rotor rotatably arranged on the first rotation shaft, wherein the first rotor comprises a plurality of first screw blades, a first tooth slot is formed between two adjacent first screw blades, and a suction end of the first rotor has at least one oil slinger slot, to allow a lubricant to enter the first tooth slot through the at least one oil slinger slot; the first rotation shaft is internally provided with a main oil path and at least one branch oil path communicating with the main oil path; and a lubrication clearance is formed between the first rotor and the first rotation shaft, and the lubrication clearance is communicated with the at least one branch oil path and the at least one oil slinger slot.

2. The rotor assembly according to claim 1, further comprising:

a second rotation shaft; and a second rotor fixedly arranged on the second rotation shaft, wherein the second rotor is meshed with the first rotor and configured to drive the first rotor to rotate relative to the first rotation shaft, and the first rotor and the second rotor rotate in opposite directions; the second rotor comprises a plurality of second screw blades, and a second tooth slot is formed between two adjacent second screw blades.

3. The rotor assembly according to claim 2, wherein the rotor assembly comprises two first rotors and two second rotors;

wherein the two first rotors are coaxially arranged on the first rotation shaft, and screw directions of first screw blades of the two first rotors are in opposite directions; the two second rotors are coaxially fixed on the second rotation shaft, and screw directions of second screw blades of the two second rotors are in opposite directions.

4. The rotor assembly according to claim 3, wherein suction ends of the two first rotors are engaged with each other, and at least one of the suction ends of the two first rotors has at least one oil slinger slot.

5. The rotor assembly according to claim 1, wherein the at least one oil slinger slot is formed at a junction of two adjacent first screw blades.

6. The rotor assembly according to claim 1, wherein the at least one oil slinger slot is formed on the first screw blade.

7. The rotor assembly according to claim 1, wherein the suction end further has at least one oil storage cavity, and the at least one oil storage cavity is communicated with the at least one oil slinger slot and is communicated with the first tooth slot through the at least one oil slinger slot.

8. The rotor assembly according to claim 7, wherein the at least one oil storage cavity is formed by one end of the first screw blade close to the suction end being recessed in a direction away from the suction end.

9. The rotor assembly according to claim 1, further comprising a plurality of support bearings sleeved outside the first rotation shaft and supporting the first rotor, wherein the plurality of support bearings and the first rotor are rotatable relative to the first rotation shaft;

a gap is arranged between two adjacent support bearings, and the gap is communicated with the branch oil path and the lubrication clearance.

10. The rotor assembly according to claim 1, wherein an inner wall of the first rotor facing the first rotation shaft has an oil storage slot communicating with the lubrication clearance.

11. The rotor assembly according to claim 1, further comprising:

a first bearing housing arranged at one end of the second rotation shaft, wherein a first bearing cavity is arranged between the first bearing housing and the second rotation shaft;

a first bearing arranged on the second rotation shaft and accommodated in the first bearing cavity;

a flow dividing part comprising an overall oil inlet, a first oil outlet and a second oil outlet, wherein two ends of the first oil outlet are respectively communicated with the overall oil inlet and the main oil path disposed in the first rotation shaft, and two ends of the second oil outlet are respectively communicated with the overall oil inlet and the first bearing cavity; and a rotor housing configured to accommodate the first rotor and the second rotor, wherein the rotor housing has a first oil return port communicated with the first bearing cavity and the second tooth slot.

12. The rotor assembly according to claim 11, further comprising:

a second bearing housing arranged at the other end of the second rotation shaft, wherein a second bearing cavity is arranged between the second bearing housing and the second rotation shaft;

a second bearing arranged on the second rotation shaft and accommodated in the second bearing cavity;

an oil control part comprising a third oil outlet, wherein two ends of the third oil outlet are respectively communicated with the main oil path and the second bearing cavity; and a second oil return port arranged on the rotor housing, wherein the second oil return port is communicated with the second bearing cavity and the second tooth slot.

13. A compressor comprising the rotor assembly according to claim 1.

14. An air conditioner comprising the compressor according to claim 13.

* * * * *